US005118044A

United States Patent [19]

Banba

[11] Patent Number: 5,118,044

[45] Date of Patent: Jun. 2, 1992

[54] METHOD FOR SEPARATING DOUBLED YARNS

[75] Inventor: Susumu Banba, Kyoto, Japan

[73] Assignee: Murata Kikai Kabushiki Kaisha, Kyoto, Japan

[21] Appl. No.: 541,137

[22] Filed: Jun. 20, 1990

[30] Foreign Application Priority Data

Jun. 23, 1989 [JP] Japan ..... 1-161094

[51] Int. Cl.[5] ..... B65H 54/70; B65H 69/06; D01H 15/00

[52] U.S. Cl. ..... 242/35.6 R; 242/42; 57/22; 57/261

[58] Field of Search ..... 242/35.6 R, 42; 57/22, 57/261, 328, 353

[56] References Cited

U.S. PATENT DOCUMENTS

| | | | |
|---|---|---|---|
| 2,863,492 | 12/1958 | Chang et al. . | |
| 3,480,216 | 11/1969 | Iannucci et al. | 242/35.6 R |
| 3,712,040 | 1/1973 | Harmon | 57/261 |
| 4,322,943 | 4/1982 | Rohner et al. | 57/261 |
| 4,570,427 | 2/1986 | Premi et al. | 57/22 |
| 4,577,459 | 3/1986 | Speranzin et al. | 57/22 |
| 4,787,566 | 11/1988 | Oellers | 242/35.6 |
| 4,799,353 | 1/1989 | Kawasaki et al. | 57/261 X |
| 4,911,372 | 3/1990 | Uchida et al. | 57/22 X |

FOREIGN PATENT DOCUMENTS

| | | | |
|---|---|---|---|
| 0361306 | 4/1990 | European Pat. Off. | 57/22 |
| 1221526 | 10/1989 | Japan | 57/328 |

*Primary Examiner*—Stanley N. Gilreath
*Attorney, Agent, or Firm*—Spensley, Horn, Jubas & Lubitz

[57] ABSTRACT

The method for separating doubled yarns comprises moving forward a clamper which is opened and closed in a manner of a pair of scissors in an open state forward two yarns arranged in a pulled form, positioning said pulled yarns into an opening of the clamper and thereafter closing the opening, clamping one yarn positioned deep in the opening more strongly than the other, and moving backward the clamper to thereby separate the strongly clamped yarn from the other while clamping the strongly clamped yarn.

7 Claims, 5 Drawing Sheets

METHOD FOR SEPARATING DOUBLED YARNS

FIELD OF THE INVENTION

The present invention relates to a method for separating doubled yarns for the purpose of joining the doubled yarns.

RELATED ART STATEMENT

When yarn breakage occurs where spun yarns are doubled and wound up onto a package as doubled yarns or two ply yarns, The spun yarns have to be joined. There is a method for joining a yarn on the delivery side and a yarn on the take up side into a single yarn. However, when this joining means is employed, problems occur with twisting in a later process.

To cope with this situation, it is necessary to separately join a single yarn on the delivery side and a single yarn on the take up side one by one. To this end, however, two ply yarns have to be separated into the respective single yarns.

In view of the foregoing, it is an object of the present invention to provide a method for separating doubled yarns in ply yarn form into respective single yarns.

SUMMARY OF THE INVENTION

One embodiment of the present invention includes moving forward a clamper which, opens and closes in a scissor-like fashion, torward two yarns, positioning the two yarns into an opening of the clamper and thereafter closing the opening, clamping one yarn positioned deep in the opening more strongly than the other, and moving the clamper in a backward fashion to thereby separate the strongly clamped yarn from the other while still clamping the strongly clamped yarn.

The clamper 13 opened and closed in a scissor-like fashion and is moved forward toward the doubled ply yarns. The doubled yarns are positioned in the opening of the clamper and a nipper is closed. At this time, the yarn positioned deep in the opening of the clamper is maintained under a different clamping pressure from that of the single yarn positioned close to the outside of the opening. The yarn positioned deep in the opening of the clamper is strongly clamped. When the clamper is moved, the clamper cannot fully clamp the yarn since the yarn positioned close to the outside of the opening of the clamper is weak in clamping pressure. Therefore, the yarn escapes from the clamping by the clamper and stops at its original position. The yarn positioned deep in the opening of the clamper moves as the clamper moves to separate into two single yarns.

BRIEF DESCRIPTION OF THE DRAWINGS

The drawings show embodiments for carrying out the method of the present invention.

DETAILED DESCRIPTION OF PREFERRED EMBODIMENT

The method of the present invention will be described hereinafter together with an embodiment of apparatus for carrying out the method of the present invention.

A first embodiment of a clamp separator 30 shown in a plan view of FIG. 1 will be described hereinafter.

Figure 1:
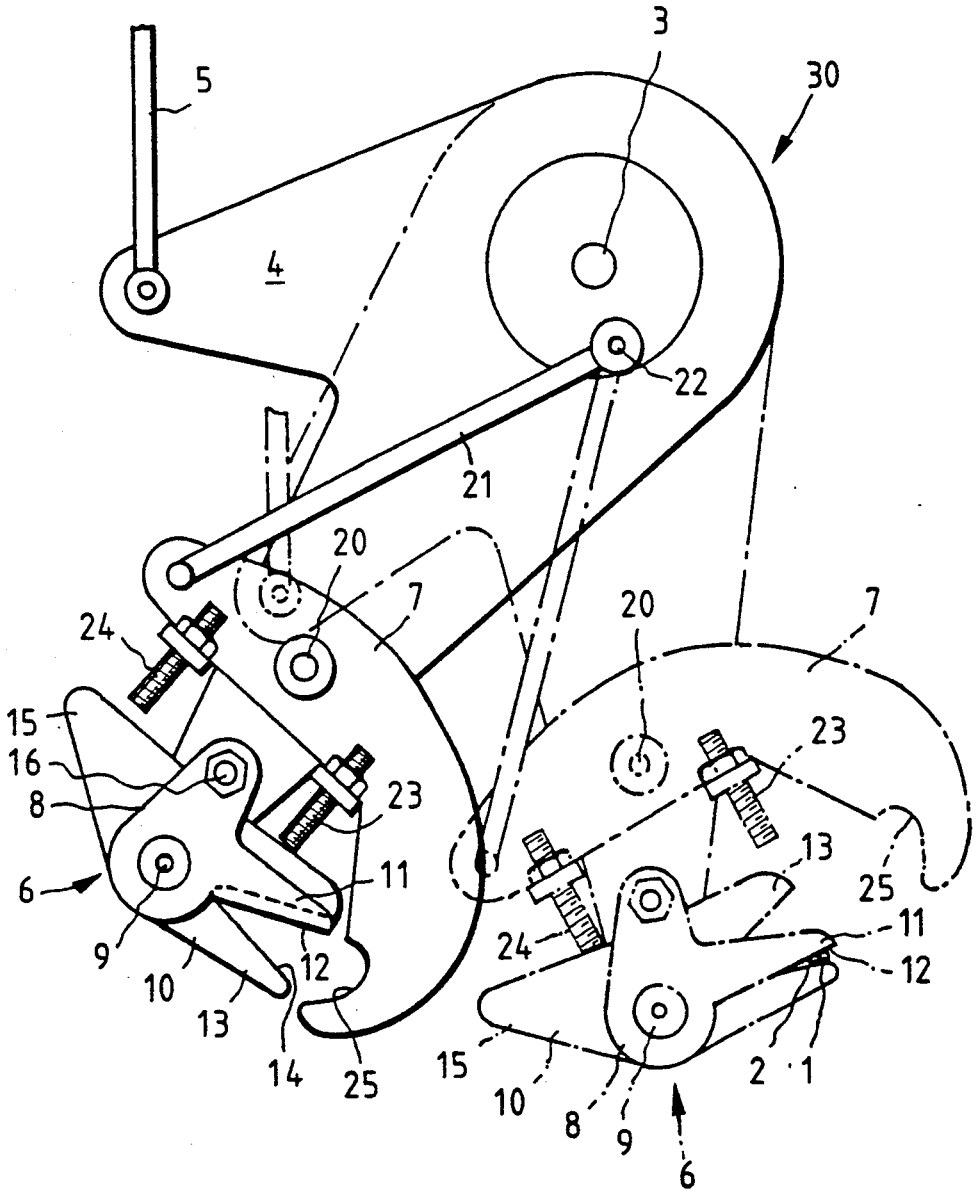
FIG. 1 is a plan view of a first embodiment.

The embodiment shown in FIG. 1 comprises an apparatus for drawing one single yarn among doubled yarns or two ply yarns including two single yarns 1 and 2 toward one side in order to separate the two single yarns 1 and 2.

A pivotal arm 4 in the shape of V is supported on a fixed shaft 3 pivotably. The pivotal arm 4 supports at an end of one arm a cam lever 5 which is reciprocated by a cam not shown, and at an end of the other arm a clamper 6 and a yarn holding lever 7. The clamper 6 is composed of upper and lower fixed plates 8 having substantially the same shape and a movable plate 10 held between two fixed plates 8 and being pivotably supported by a shaft 9. The upper and lower fixed plates 8 are designed so that a clamp edge 12 is provided on the end edge of a clamp member 11, and the movable plate 10 is designed so that a clamp edge 14 is formed on the inner edge of a /\-shaped clamp member 13 opened in the shape of /\. The movable plate 10 is pivotably supported on the shaft 9 as described above but has a projecting arm 15 on the opposite side of the /\-shaped clamp member 13. The clamper 6 is secured to the pivotal arm 4 by suitable means such as bolt 16.

The yarn holding lever 7 is pivotably supported on the pivotal arm 4 by means of a shaft 20, one end of which is attached at support point 22 by a turnbuckle 21. The support point 22 is fixed to a position eccentric with respect to the shaft 9 away from the fixed shaft 3. The yarn holding lever 7 is provided with adjust bolts 23 and 24 make contact with the /\-shaped clamp member 13 of the clamper 6 and the projecting arm 15, respectively. A guide recess 25 is formed in the end of the lever 7.

In separating the doubled yarns 1 and 2 in FIG. 1, the pivotal arm 4 at the stand-by position shown at the solid line is oscillated through the cam lever 5 by rotating a cam not shown to move forward the cam lever 5 by the presence of the top of the cam to assume a position indicated by the phantom line. The yarn holding lever 7 is pressed by the turnbuckle 21 due to the oscillation of the pivotal arm 4 and turns counterclockwise about the shaft 20 to bring the adjust bolt 24 into contact with the projecting arm 15 of the movable plate 10 of the clamper 5, to cause the movable plate 10 to be turned counterclockwise about the shaft 9 and to move the clamp edge 14 of the /\-shaped clamp member 11 at the end thereof close to the clamp edge 14 provided on the clamp member 11. Thereby, the single yarns 1 and 2 are clamped. At this time, the single yarn 2 positioned deep in the opening of the clamper 6 is more strongly clamped than the single yarn 1 positioned outwardly of the opening. In this state, when the unshown cam is further rotated, the cam lever 5 is returned, and when the pivotal arm 4 is oscillated clockwise, only the single yarn 2 strongly clamped is drawn leftward while being clamped by the clamper 6. In the vicinity of the pivotal end caused by the oscillation of the pivotal arm 4 clockwise, the adjust bolt 23 comes into contact with the /\-shaped clamp member 13 of the movable plate 10. The clamp member 13 turns clockwise about the shaft 9 by means of the bolt 23. Therefore, the clamp edge 12 of the clamp member 11 of the fixed plate 8 and the clamp edge 14 of the movable plate 10 are opened, during which the single yarn 2 being clamped is released. The yarn holding lever 7 is turned clockwise about the shaft 20 by the turnbuckle 21, and the single yarn 1 remains and is guided while being supported by the guide recess 25 at the end thereof to separate two singles yarns 1 and 2. Thus, the single yarn 1 and the single yarn 2 are spaced from each other with the holding lever 7.

A second embodiment will be described hereinafter. In the second embodiment, two single yarns in a pulled form are separated sideway.

Figure 5:
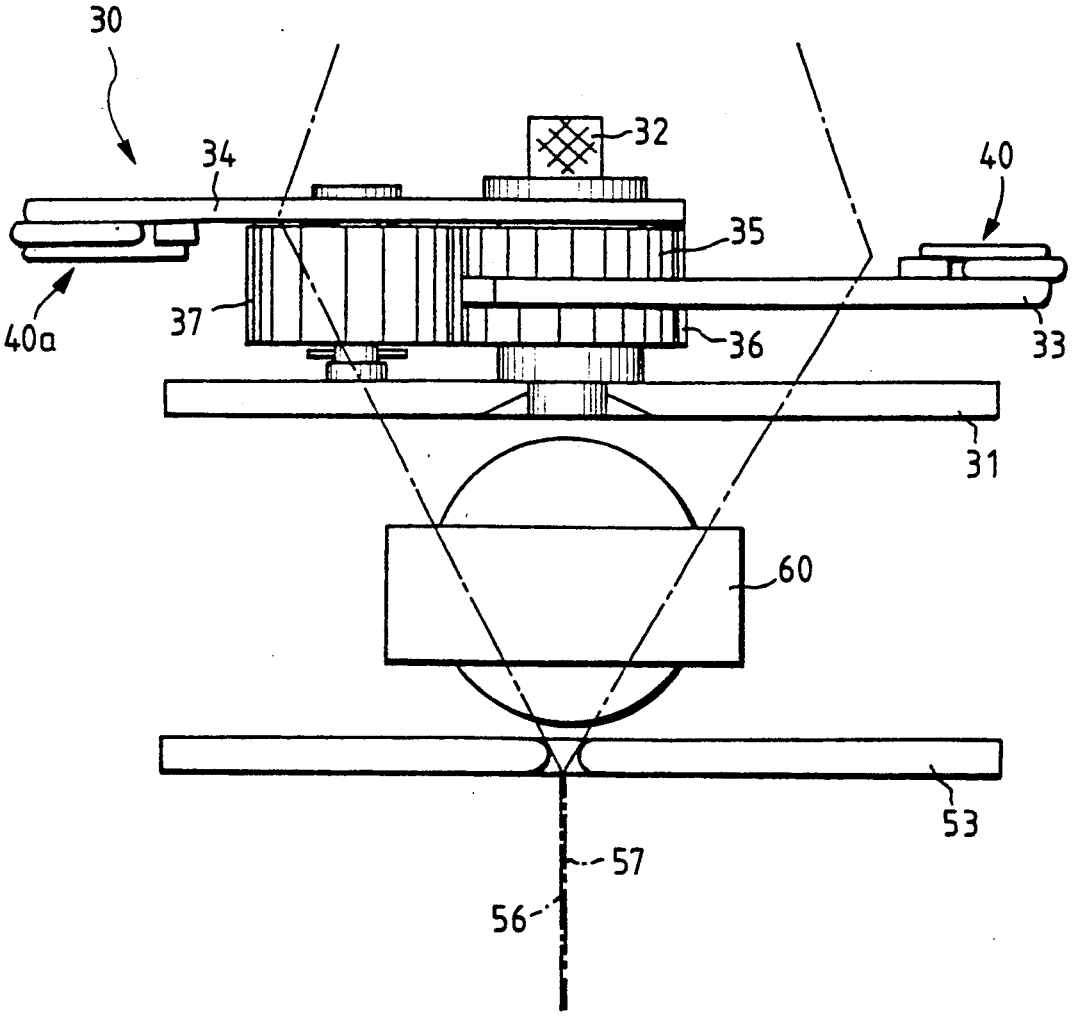
FIG. 5 is a front view of a second embodiment.
Figure 6:
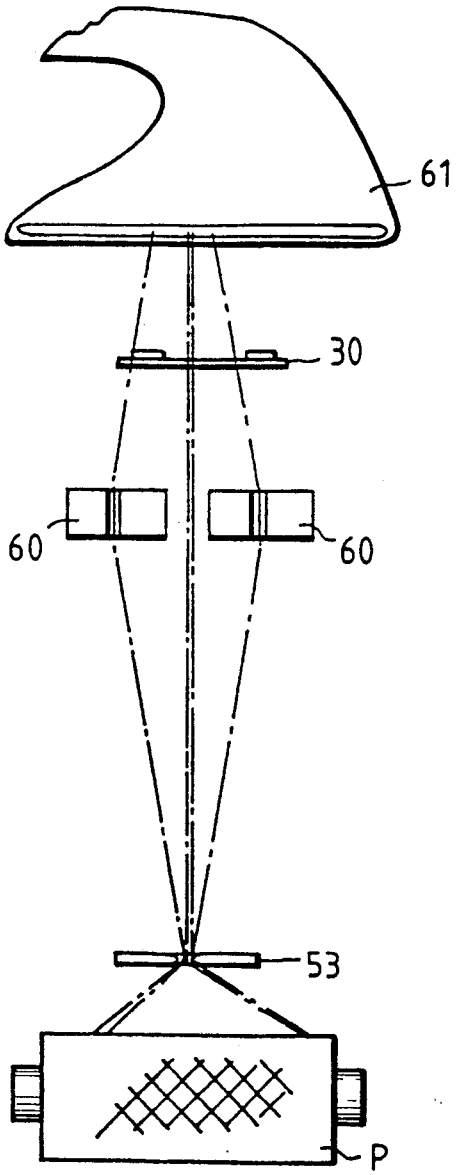
FIG. 6 is a schematic front view showing an arrangement of a separator.

Two pivotal arms 33 and 34 are supported by a shaft 32 on a required portion of an upper guide plate 31. The pivotal arm 33 is pivotably supported on the shaft 32 through a gear 35 provided integral with a bearing portion, and a fixed gear 36 is provided on the shaft 32 (FIG. 5). The pivotal arm 35 supported on the shaft 32 is pivotable separately from the pivotal arm 33, and a gear 37 is supported in the central portion of the arm. The gear 37 is meshed with the fixed gear 36. A connecting rod 38 is provided on the end extended from the pivotal arm 33, the rod 38 being fixed in position.

Figure 4:
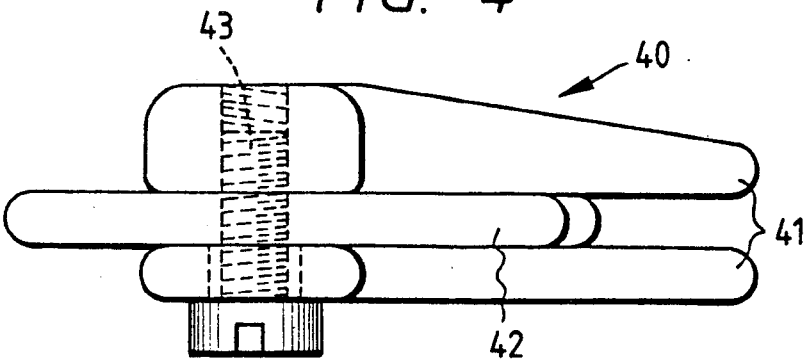
FIG. 4 is a side view of the same.

Clampers 40 and 40*a* are provided at the end of the pivotal arms 33 and 34. The clampers 40 and 40*a* have the same construction and have a movable plate 42 held between two fixed plates 41 as shown in FIG. 4, the fixed plate 42 being pivotably supported by a shaft 43. The movable plate 42 has substantially a Y-shape, and left and right projecting portions 44 and 45 constituting the Y-shape are placed in contact with a pin or the like which will be described later to turn about the shaft 43. A clamp edge 46 is opposed to a clamp edge 47 of the fixed plate 41 to thereby clamp a yarn.

Clamp openers 48 and 49 are provided on the side of the upper guide plate 31. The clamp openers 48 and 49 include a bolt 50 provided adjustably in projected position by a support member 51, so that when the end of the bolt 50 comes into contact with one projecting portion 44 of the Y-shaped projecting portions 44 and 45 of the movable plate 42, the movable plate 42 is turned to move the clamp edge 46 from the clamp edge 47 of the fixed plate 41. A clamp pin 52 is provided in the central portion of the end of the upper guide plate 31. The clamp pin 52 comes into contact with the projecting portion 45 of the movable plate, and the clamp edge 46 is moved closer to the clamp edge 47 of the fixed plate 41 to clamp a yarn therebetween. The front edge 59 of the upper guide plate 31 constitutes a guide edge of a yarn.

An arrow-like lower guide 53 is provided below the upper guide plate 31. The lower guide plate 53 is supported by a support member 62, and a guide edge 54 opened in the shape of V is provided at the end thereof. A yarn guide groove 55 is provided in the V-shaped guide edge 54.

Figure 2:
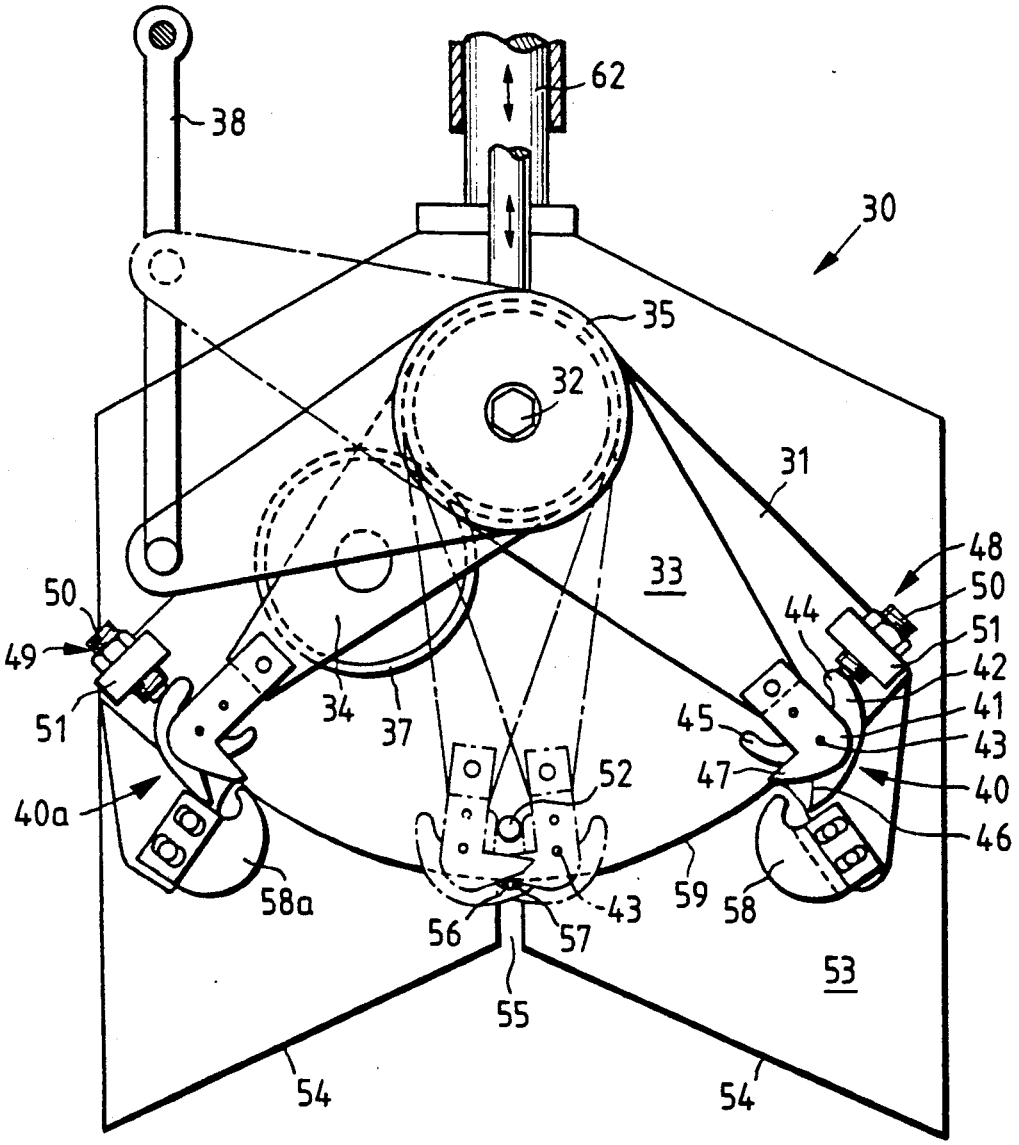
FIG. 2 is a plan view of a second embodiment.
Figure 3:
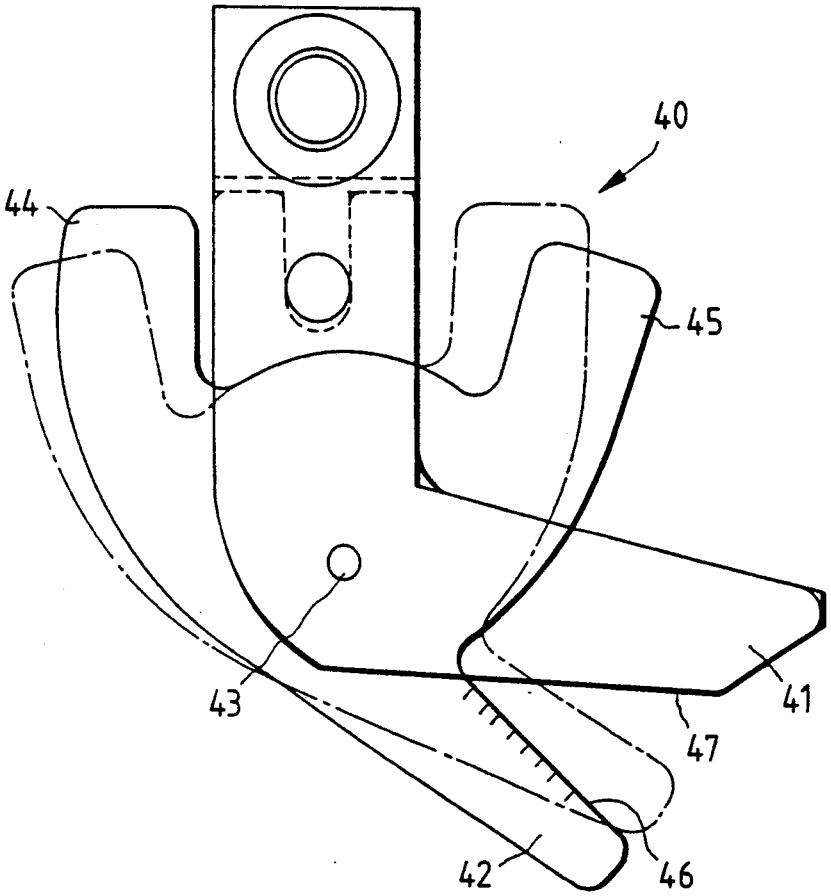
FIG. 3 is a plan view of a clamper.

In separating doubled yarns composed of two single yarns 56 and 57 to left and right, the upper guide plate 31 and the lower guide plate 53 are moved forward toward the yarns 56 and 57 to move the yarns 56 and 57 into the yarn guide groove 55 by the V-shaped guide edge 54 of the lower guide plate 53. The forward movement of the upper guide plate 31 results in the clockwise turning about the shaft 32 of the pivotal arm 33 through the rod 38, and the clampers 40 and 40*a* at the position indicated at the solid line in FIG. 2 assume the position of the pivotal arm indicated by the phantom line, that is, approaches the guide groove 55. That is, the turning of the pivotal arm 33 rotates the gear 35 integral therewith, which tends to rotate the gear 37 meshed with the gear 35. However, since the gear 37 is also meshed with the fixed gear 36 (shown in FIG. 5), the pivotal arm 34 is turned by the rotation of the gear 37 about the shaft 32 counterclockwise which is the converse of the turning of the pivotal arm 33, and as a consequence, both the pivotal arms 33 and 34 cause the clampers 40 and 40*a* provided at the end thereof to move closer to the yarns 56 and 57 positioned in the central portion of the upper guide plate 31. And, in the central position, a projection 45 of the movable plate of the clampers 40 and 40*a* and a clamp pin 52 come into contact with each other so that the movable plate 42 turns about the shaft 43. The yarn is clamped by the clamp edge 46 thereof and the clamp edge 47 of the fixed plate 41. Since at this time, the single yarns 56 and 57 are in contact with the guide edge 59 of the front edge of the upper guide plate 31, they present a state such that they are always disposed in a lateral direction, and the single yarns positioned to left and right are clamped by clampers which are moved closer from left and right sides, respectively.

When both the guide plates 31 and 53 are then moved backward, the pivotal arms 34 and 34 turn, and the clampers 40 and 40*a* reach both left and right positions of the upper guide plate 31. As previously mentioned, the clampers 40 and 40*a* open clamping the yarn and the single yarns 56 and 57 are released and separated and stopped at yarn hooks 58 and 58*a*. Yarns are then delivered to a splicer 60.

A clamp separator 30 used in the method of the present invention is designed so that a yarn from a package P is drawn out by a suction mouth 61 to guide it to paired splicer nozzles 60 and 60, and therefore, the separator 30 is preferably provided above the splicer nozzles 60 and 60.

According to the present invention, a clamper which is opened and closed in a scissor-like fashion is moved forward toward two yarns arranged in a pulled form, the pulled yarns are positioned into an opening of the clamper and thereafter the opening is closed, one yarn positioned deep in the opening is clamped more strongly than the other, and the clamper is moved backward to thereby separate the strongly clamped yarn from the other while maintaining a strong clamping force on one of the yarns. Therefore, the clamper moves close to the doubled yarns from one side or both sides thereof to separate the two yarns into single yarns. Thus, joining of each yarn strand of doubled yarns can be accomplished.

What is claimed is:

1. A method for separating doubled yarns comprising the steps of:

moving a clamper in a first direction toward two yarns arranged in a parallel form, wherein the clamper can be opened and closed in a scissor-like fashion, positioning the two yarns into an opening of the clamper and thereafter closing the opening to thereby clamp the two yarns in the clamper, wherein one of the two yarns is positioned deeper in the opening than the other of the two yarns, clamping the yarn positioned deeper in the opening more strongly than the other, and moving the clamper in a second direction in order to separate the two yarns, wherein the yarn positioned deeper in the opening is maintained in a clamped position in the clamper and the other of the two yarns is released from the clamper.

2. A device for separating a ply yarn including at least first and second doubled yarns, comprising:

a pivotal arm, clamp means mounted at an end of the pivotal arm, the clamp means including two fixed plates having substantially the same shape and a movable plate movably held between the two fixed plates and being supported by a shaft, the movable plate being movable with respect to the two fixed plate in a scissor-like fashion, thereby enabling the clamp means to clamp yarn between the movable plate and the two fixed plates, moving means for moving the movable plate, and driving means for driving the pivotal arm such that the clamp means moves in first and second directions, wherein the clamp means is moved in the first direction to clamp the first and second yarns and is moved in the second direction to separate the first and second yarns such that the first yarn is held by the clamp means and the second yarn is released from the clamp means.

3. A device for separating doubled yarns as claimed in claim 2, wherein a yarn holding member is pivotably supported at a position where the second yarn is released from the clamp means.

4. A device for separating doubled yarns as claimed in claim 3, wherein said pivotal arm is "V-shaped", the device including a cam lever movably attached at one end of the V-shaped pivotal arm, wherein the clamp means and a yarn holding lever are movably attached to another end of the V-shaped pivotable arm.

5. A device for separating doubled yarns as claimed in claim 3, including two pivotal arms movably supported by a shaft and two clamp means respectively provided at an end of each of the two pivotal arms, respectively.

6. A device for separating doubled yarns as claimed in claim 5, wherein the driving means includes a connecting rod provided on an end of one of the pivotal arms, a fixed gear provided on the shaft supporting the pivotal arms, and a gear movably supported by one of the two pivotable arms which meshes with the fixed gear.

7. A device for separating doubled yarns as claimed in claim 6, wherein operating means are provided on both sides of the guide plate, and a clamp pin is provided in a central portion of the guide plate so that the clamp pin comes into contact with the movable plate of each of the clamp means, thereby closing each of the clamp means and clamping a yarn between the movable plate and the fixed plates of the clamper.

* * * * *